US006751165B2

(12) United States Patent
Blonder

(10) Patent No.: US 6,751,165 B2
(45) Date of Patent: Jun. 15, 2004

(54) DIGITAL TIMEPIECE WITH APPROXIMATE TIME MESSAGING

(75) Inventor: Greg E. Blonder, Summit, NJ (US)

(73) Assignee: Genuine Ideas, LLC, Summit, NJ (US)

( * ) Notice: Subject to any disclaimer, the term of this patent is extended or adjusted under 35 U.S.C. 154(b) by 1 day.

(21) Appl. No.: 09/992,577

(22) Filed: Nov. 14, 2001

(65) Prior Publication Data

US 2003/0090961 A1 May 15, 2003

(51) Int. Cl.[7] ..... G04B 19/00; G04C 17/00
(52) U.S. Cl. ..... 368/82; 368/223; 368/239
(58) Field of Search ..... 368/76, 84, 223, 368/231, 242, 89, 82

(56) References Cited

U.S. PATENT DOCUMENTS 6,307,813 B1 * 10/2001 Leggio ..... 368/63
6,421,302 B1 * 7/2002 Wimberly ..... 368/223

* cited by examiner

*Primary Examiner*—David Martin
*Assistant Examiner*—Jeanne-Marguerite Goodwin

(57) ABSTRACT

In accordance with the invention, a digital timepiece is provided with a mode of operation which presents a time message indicative of the approximate time. The mode can be implemented by adding to a digital timekeeping circuit, a digital conversion circuit to generate the messages. A visual display on the timepiece face displays the message. In a preferred embodiment the precise time can be displayed as an alternative mode.

7 Claims, 2 Drawing Sheets

DIGITAL TIMEPIECE WITH APPROXIMATE TIME MESSAGING

FIELD OF THE INVENTION

This invention relates to timepieces such as watches and clocks and, in particular, to an improved digital timepiece adapted to provide messages indicative of the approximate time.

BACKGROUND OF THE INVENTION

Timepieces are now accurate and precise beyond usual human need. Inexpensive digital watches, for example, can display time to a tenth or even a hundredth of a second periods too short for human response. Moreover displays of such precision can, at a quick glance, be readily misinterpreted. For example, a quick glance at 12:58 may focus on the 12 without the recognition that the time is much closer to 1:00 than to 12:00.

Analog watches are easier to interpret, but suffer from mechanical problems and are expensive to make. They are difficult to read under low-light conditions and mistakes are made in matching hour hand with the hour tick-mark on the face. Accordingly there is a need for a timepiece provided with an approximate time message readily interpretable upon a quick glance.

SUMMARY OF THE INVENTION

In accordance with the invention, a digital timepiece is provided with a mode of operation which presents a time message indicative of the approximate time. The mode can be implemented by adding to a digital timekeeping circuit, a digital conversion circuit to generate the messages. A visual display on the timepiece face displays the message. In a preferred embodiment the precise time can be displayed as an alternative mode.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that these drawings are for illustrating the concepts of the invention and are not to scale.

DETAILED DESCRIPTION

Figure 1A:
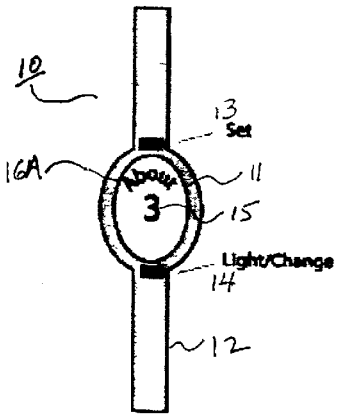
FIGS. 1A, 1B and 1C are schematic illustrations of an exemplary timepiece in accordance with the invention displaying representative approximate time messages.
Figure 1B:
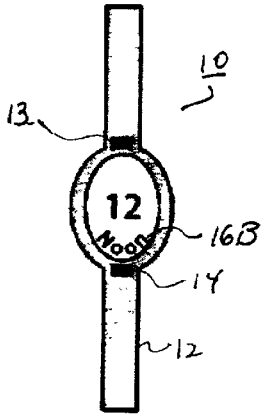
Figure 1C:
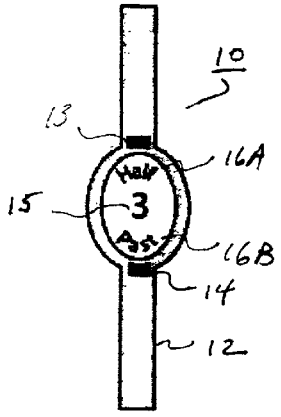

Referring to the drawings, FIGS. 1A, 1B, and 1C are schematic views of an exemplary timepiece 10 in accordance with the invention presenting different approximate time messages. FIG. 1A illustrates a timepiece (here a watch) providing an approximate time message. The timepiece 10 is preferably in the form of a digital watch including a face 11, an attachment mechanism such as a wrist band 12 (or a ring band or a neck band), a set button 13 and a mode button 14. In a preferred form, the timepiece includes a display 15 for displaying a near hour in the center of face 11 and includes displays 16A, 16B above and below the hour display to provide text messages. The combination of text and hour provides an approximate and appropriate measure of the current time that can be readily interpreted at a quick glance. FIG. 1A, for example, indicates about 3:00. FIG. 1B shows approximately noon, and FIG. 1C indicates about 3:30. By approximate time, it is meant that the same message will apply over a period of at least five minutes. In a preferred form, the timepiece also retains the conventional precise time mode as an alternative that the user can access via mode button 14. By precise time, it is meant that the time is separately indicated for each minute or less.

Figure 2:
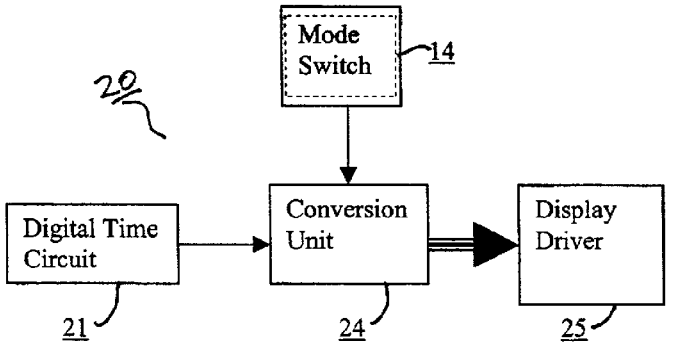
FIG. 2 is a schematic diagram of a timekeeping circuit provided with a conversion unit for the timepiece of FIGS. 1A–1C.

The subject timepiece can be achieved, for example, by providing conversion functionality to a conventional digital clock timing circuit FIG. 2 schematically illustrates a circuit 20 provided with such functionality. In essence a digital timekeeping circuit unit 21 is switched by mode switch 14 between driving a conventional display 23 or providing an input to a conversion unit 24 which, in turn, activates an approximate time display driver 25. Typical conversion functionality is illustrated in table 1, below.

TABLE

| DISPLAY | START TIME | END TIME |
|---|---|---|
| Around 6 o'clock | 5:57 | 6:03 |
| Slightly After 6 | 6:03 | 6:10 |
| Around 6 Fifteen | 6:10 | 6:20 |
| Nearly 6 Thirty | 6:20 | 6:25 |
| Half Past 6 | 6:25 | 6:35 |
| Nearly 6 Forty Five | 6:35 | 6:40 |
| Quarter To 7 | 6:40 | 6:50 |
| Just Before 7 | 6:50 | 6:57 |
| Around 7 o'clock | 6:57 | 7:03 |
| About 12 Noon (or midnight) | 11:57 | 12:03 |

Typical time intervals for approximation can range from 5 to 10 minutes, and the intervals are advantageously shorter near the hour. In preferred form the mode switch is normally on the approximate time messaging. The conventional precise time display can be temporarily accessed by pressing the mode button.

The conversion unit 24 can be in the form of digital circuitry or largely in the form of software. In its simplest form, it is essentially a look-up table responsive to the output of the digital timekeeping circuit. In response to a timekeeping signal falling within each chosen interval, the conversion unit activates the displays to provide a predetermined approximate time message such as exemplified in table 1.

Figure 3:
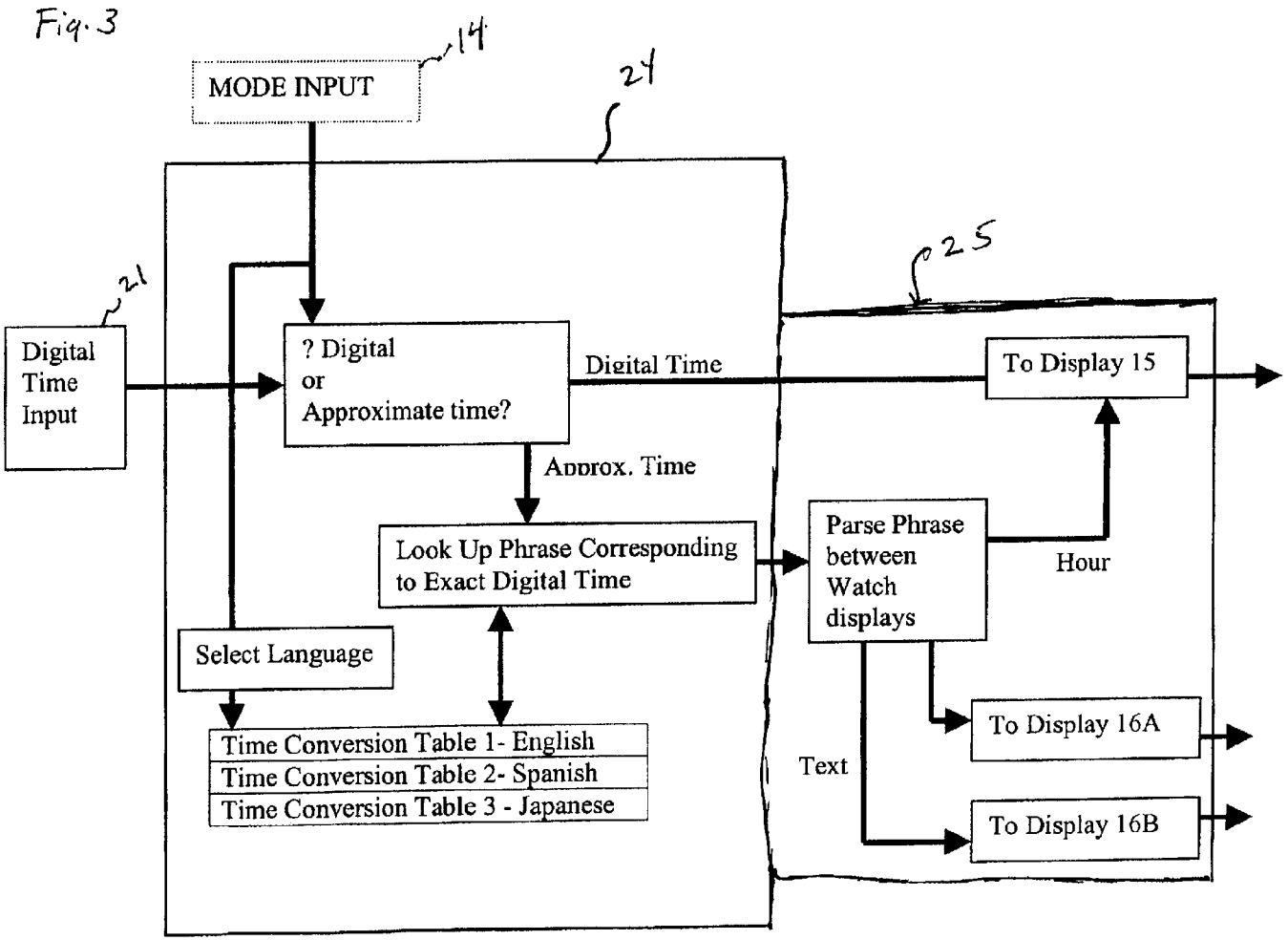
FIG. 3 is a functional diagram of a preferred conversion unit.

FIG. 3 provides an implementation of an exemplary unit 24.

The mode and set switch can allow access to a multiplicity of functions. For example, the watch may be designed for the global market. In this case, by repeatedly pressing the mode switch it cycles the language of the displayed approximate time—e.g. among English, Spanish, and Japanese, Pressing the "set" button can select that particular language for display, until changed again with the mode button.

Alternatively, the watch may display all messages in English, but vary the style and tone of each message. For example, one grouping of messages might be in plain English, as in Table 1. Another grouping might be inspired by movies—e.g. "About Noon" replaced with "High Noon", and "About Midnight" with "Midnight Cowboy". Yet another grouping might adapt to regional slang, and so on. Again, the mode and set buttons are used to cycle and select a grouping for display.

Some messages might repeat only once a year—e.g. "Happy New Year" at midnight January 1, or "Happy Anniversary", displayed all day on your wedding anniversary.

It is understood that the above-described embodiments are illustrative of only a few of the many possible specific embodiments, which can represent applications of the invention. Numerous and varied other arrangements can be made by those skilled in the art without departing from the spirit and scope of the invention.

What is claimed:

1. A digital timepiece comprising:

a face including a display for displaying a digital, numerical hour and a message, the digital, numerical hour and the message indicative of approximate time;

a digital timekeeping circuit for generating a signal indicative of precise time; and a conversion unit responsive to a digital timekeeping signal for generating on the display the digital, numerical hour and the message, indicative of the approximate time a mode switch for switching modes between the display of the digital, numerical hour and the message, indicative of the approximate time and a display of precise time.

2. The timepiece of claim 1, wherein the displayed messages vary more frequently near an hour.

3. The timepiece of claim 1, wherein the displayed messages vary more frequently near a half hour.

4. The timepiece of claim 1, wherein the digital, numerical hour is displayed in a larger size font than the message.

5. The timepiece of claim 1, wherein the digital, numerical hour is displayed approximately in the center of the display.

6. The timepiece of claim 1, wherein the displayed message contains words.

7. The timepiece of claim 6, wherein the words are from a selected language.

* * * * *